United States Patent [19]

Jones, Jr.

[11] 4,380,339

[45] Apr. 19, 1983

[54] GAME DEVICE

[76] Inventor: Andrew Jones, Jr., 608 Easton Ave., NW., Washington, D.C. 20019

[21] Appl. No.: 292,608

[22] Filed: Aug. 13, 1981

[51] Int. Cl.[3] ..... A63F 9/02; F41J 7/00

[52] U.S. Cl. ..... 273/384; 273/1 GF; 273/379; 273/387

[58] Field of Search ..... 273/1 GF, 379, 384, 273/386, 387

[56] References Cited

U.S. PATENT DOCUMENTS

| | | | |
|---|---|---|---|
| 3,612,527 | 10/1971 | Rogerson | 273/1 GF |
| 3,656,748 | 4/1972 | Howard | 273/387 |
| 3,764,134 | 10/1973 | Reinertsen | 273/1 GF |
| 4,169,593 | 10/1979 | Wood | 273/1 GF |

*Primary Examiner*—Anton O. Oechsle

*Attorney, Agent, or Firm*—Cushman, Darby & Cushman

[57] ABSTRACT

A game device comprises an elongated trunk element, a plurality of elongated limb elements, a trunk member defining an elongated trunk cavity for axially positioning the elongated trunk elements therein, and including a plurality of limb members each defining a limb cavity for axially positioning at least one of said limb elements therein; hinges connecting the limb elements to the trunk element, a platform transversely mounted to the trunk element for supporting weighted objects thereon and spring for biasing the trunk element in an upward direction so that the trunk element will be yieldably and incrementally depressed in the trunk cavity in response to successive weighted objects being placed upon the platform member.

15 Claims, 2 Drawing Figures

GAME DEVICE

BACKGROUND AND SUMMARY OF THE INVENTION

The present invention generally relates to a game device which can be utilized competitively, such as, for games of skill or for gaming purposes. More specifically, the present invention relates to a game device which is adapted to having weighted objects thrown or tossed onto a platform of the device in such a manner that competitive games or games of skill can be practiced or played.

Historically, games have been utilized as a means of competition which are simulative of ancient combat between the competitors. Competitive games often have as their primary object, the winning of certain prizes to entice the competitors to play particular games. Moreover, games have been utilized and associated with gambling or betting. When games are utilized for gambling purposes, often the prize is in the form of money, or in the form of valuable objects.

Often, games can be utilized without the aspect of competition in order to sharpen ones skills. Certain games have been devised which enable a player to practice and therefore define hand-eye coordination or the like. Certain games, while not being competitive, do offer a form of relaxation or enjoyment to the person utilizing the game device.

According to the present invention, there is provided a game device which can satisfactorily be utilized for all normal purposes for which a game is or has been historically used. The device according to the present invention can be so constructed so that it is lightweight and, additionally, easily transportable from one location to another. Additionally, the device according to the present invention can be utilized for either a competitive nature, gambling purposes, or as a non-competitive device for improving or defining ones hand-eye coordination.

The game device according to the present invention generally comprises a trunk element which is preferably situated generally perpendicular to the horizontal plane, and which defines a central cavity into which an elongated member can be placed for reciprocal movement therein. The trunk member includes limb members which radially extend from the main trunk member and define discrete limb cavities. Associated with each limb cavity there is provided a limb element which can be hingedly attached to the central trunk element. The limb elements generally extend for a predetermined distance beyond the terminal end of each limb member such that prize objects can be releasably and appendantly attached thereto.

The game device according to the present invention additionally has a platform member which is located at the upper portion of the device and which is adaptable for accepting and supporting weighted objects which have been placed or thrown thereon. The platform member is biased in an upward direction by suitable biasing means, such as, for example, a spring, such that the successive weight of the objects placed upon the platform member will yieldably allow the trunk element to decrease in incremental distances corresponding to the increased weight of each successively placed weighted object upon the platform member.

In such a manner, the game device according to the present invention can be utilized to practice one's throwing skills. The weighted objects can be thrown from a distance away from the present game device with the ultimate aim of having the thrown weighted object come to rest upon the platform. Therefore, it will be readily apparent from the discussion below that if a player is readily adept at throwing weighted objects upon the platform, the trunk element will yieldably be displaced in a downward manner thereby causing each limb element to be withdrawn and decreasing the distance which it extends past the end of each limb member. Therefore, a point will be reached when one weighted object will cause the limb members to totally recede into the cavity defined by the limb members thereby causing the prize objects which have been appendantly attached thereto to become free and drop to the ground. It is the release of the prize objects that the players utilizing the game device according to the present invention seek since, when such prize objects drop, it is an indication that the game is over and the person who has caused such prize objects to drop will be the winner of the game being played.

Further advantages of utilizing the game device of the present invention will become more apparent from a reading of the detailed description of the invention which follows together with reference to the drawings.

DETAILED DESCRIPTION OF THE EXEMPLARY EMBODIMENT OF THE PRESENT INVENTION

Figure 1:
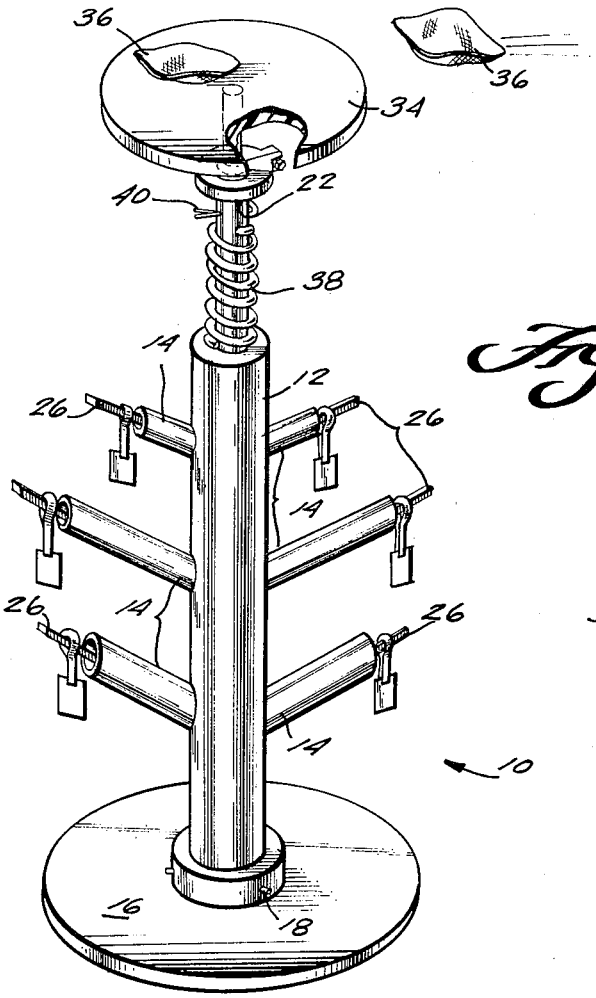
FIG. 1 is an elevational perspective view of a preferred exemplary embodiment of the present invention showing the platform partially in section.

Referring now more specifically to the drawings, wherein the preferred embodiment of the game device 10 according to the present invention is depicted, it will be readily apparent that the game device is generally comprised of an elongated trunk member 12 from which there is radially extended a plurality of limb members 14.

The trunk member 12 is preferably mounted in such a manner that is generally perpendicular to a horizontal plane. Mounting the trunk member 12 in such a generally perpendicular manner can be achieved by utilizing a base member 16 which has suitable mounting structures, such as, for example, mounting pins 18 which securely attach the base member 16 to the trunk member 12. The mounting pins 18 can be provided such that they are removably placed in the base member 16 and trunk member 12 to provide a convenient method of disassembling the game device 10 of the present invention thereby rendering it more readily transportable.

Figure 2:
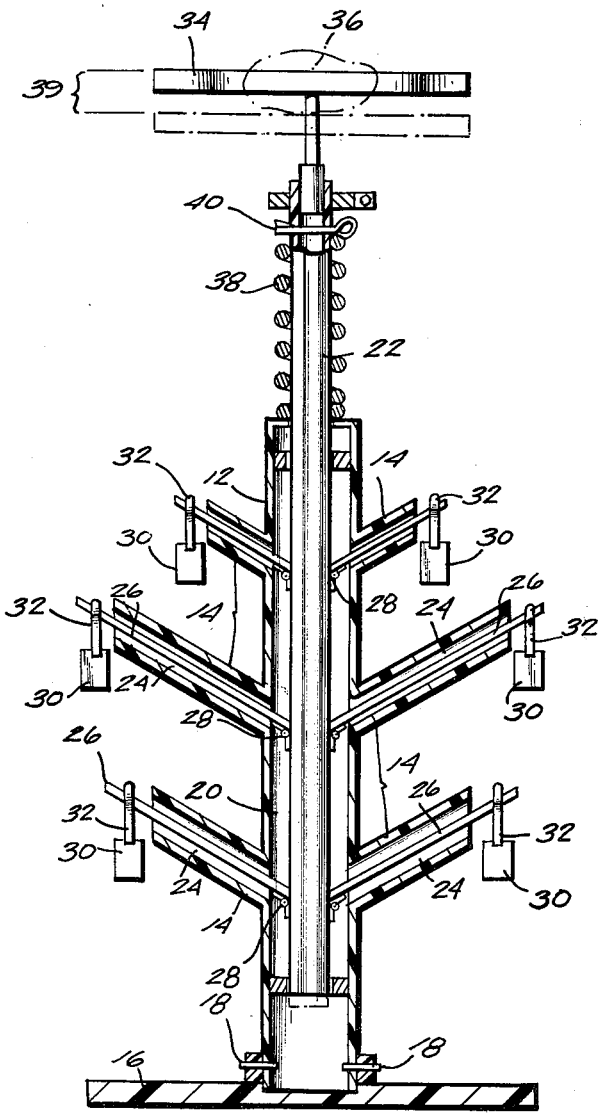
FIG. 2 is an elevational cross-sectional view of the embodiment depicted in FIG. 1.

Referring now more specifically to FIG. 2, it can be seen that the trunk member 12 defines a trunk cavity 20 into which an elongated trunk element 22 can be axially positioned. The trunk element 22 is axially positioned in the trunk cavity 20 in such a manner that a portion of the trunk element 22 extends above the terminal upper end of the trunk member 12.

Each limb member 14 defines a discrete limb cavity 24 into which a limb element 26 can be axially positioned therewith. Limb elements 26 are axially positioned in each limb cavity 24 in such a manner that they radially extend from trunk element 22. Limb elements 26 can be hingedly connected to the trunk element 22 by utilizing a suitable structure, such as, for example, a hinge 28 or the like.

Limb elements 26 radially extend from the trunk element 22 in such a manner that a predetermined portion of the limb element extends beyond the terminal end of each associated limb member 14. The portion of the limb element 26 which extends beyond the terminal end portion of the limb member 14 is utilized according to the present invention to removably and appendantly attach prize objects 30 thereto. The prize objects 30 can be appendantly attached to the limb element 26 by any suitable attaching structures 32, such as, for example, paper clips, rubber bands, thread, string, or the like. When flat objects, such as, cards, money, or the like are used as prize objects 30, paper clips or other suitable attaching structures 32 can be utilized. However, if larger objects, such as, for example, toys, candy, or objects of intrinsic value are used, any suitable attaching structure 32 such as, string, rubber bands or the like, can be utilized to removably yet appendantly attach the prize object 30 to the limb element 26.

On the upper portion of the trunk element 22 which extends above the upper end of the trunk member 14, there is provided a platform member 34 which is transversely mounted relative to the trunk element 22. Platform member 34 preferably is a structure which defines a horizontal plane onto which weighted objects 35 can be supported. The platform member 34 is utilized by the present invention primarily as a target for throwing or tossing weighted objects 36 by a player (not shown). The weighted objects 36 which are tossed by the player and which reach platform member 34 can be supported thereby. It should be realized, however, that other surfaces other than a planar surface can be utilized with satisfactory results according to the present invention. Thus, a dish-shaped platform member can be utilized. However, a planar platform member is preferable since the planar nature of the platform member 34 will provide a more difficult target for the player thereby causing the weighted objects to be thrown with more careful attention and accuracy.

An important aspect of the device according to the present invention is the spring 38 which is utilized to upwardly bias platform member 34. Spring 38 is generally utilized to oppose the force of the weighted objects 36 which come to rest upon platform member 34. Thus, as successive weighted objects are thrown and come to rest upon the platform member 34, the spring 38 will be of sufficient force to oppose any additional force caused by the successive placement of weighted objects upon the platform member 34. However, the spring 38 will yieldably compress under the incremental weight of successively thrown weighted objects 36 in such a manner that the trunk element 22 will be depressed an incremental distance 39 in the trunk cavity 20 (as noted in phantom line in FIG. 2. The spring 38 has a suitable retaining structure 40 which can be, for example, a pin, clamp, or the like.

A game which can be played utilizing the device according to the present invention is initiated by appendantly attaching suitable prize objects 30 onto the limb elements 26. It should be realized that at least one prize object on at least one limb element will need to be appendantly attached in order to provide suitable prize for competitors. However, if the game device is being utilized merely to practice one's skill or for improving one's hand-eye coordination, no prize elements need to be attached to the limb elements.

With the prize objects 30 properly attached to the limb elements, a player will stand a predetermined distance away from the game device 10 and toss weighted objects 36 at the platform member 34. It is the object of the game to toss the weighted objects 36 with sufficient trajectory such that they come to rest upon platform member 34. Players can successively take turns in attempting to place their weighted objects on the platform member 34. Therefore, the weighted objects can be of two or more colors to differentiate between which player has placed the objects upon the platform member 34.

One variation of the game is to have each player successively attempt to place their weighted objects onto the platform member 34. When the platform 34 is supporting the weighted objects which have been placed thereon, the trunk element 22 will be depressed into the trunk cavity 20. Thus, with each successive weighted object that comes to rest upon the platform member, the trunk element will be further incrementally depressed a predetermined distance in the trunk cavity which thereby causes each limb element 26 to be withdrawn into the associated limb cavity 24. In such a manner, the predetermined distance that each limb element 26 extends beyond its associated limb member 14, is decreased. Thus, there will reach a point when the next weighted object which comes to rest upon the platform member will cause the trunk element 22 to move an incremental distance and be displaced within the trunk cavity 20 such that the limb elements 26 will be withdrawn at least flush with the end of its associated limb member 14. When this occurs, the prize objects 30 appendantly attached to limb elements 26 will fall thereby designating the winner. The person entitled to the prize objects 30 which fall is that person who has the greatest number of bags supported by the platform member. However, another variation of a game utilizing the present invention would determine the winner of the prize objects 30 that fall as that person who tossed the final weighted object 36 which caused such prize objects 30 to fall.

It should be appreciated that the distance that the limb elements can extend beyond its associated limb member does not have to be equivalent. Thus, depending upon the distance that each limb element extends beyond its associated limb member, the prize objects 30 can be caused to fall concurrently or, alternately in a predetermined manner. Thus, the greater the distance that a limb element 26 extends beyond its associated limb member 14, the more weighted objects must be supported by the platform member 34 in order to cause the prize object 30 associated therewith to fall. Conversely, the shorter the distance that the limb element 26 extends beyond the end of its associated limb member 14, the less weighted objects are necessary to be supported upon the platform member 34 in order to cause the prize object 30 associated therewith to fall.

While the present invention has been described in what is presently conceived to be the most practical and preferred embodiment thereof, it will be apparent to those of ordinary skill in the art that many modifications may be made within the spirit and scope of the invention, which scope is to be accorded the broadest interpretation of the appended claims so as to encompass all equivalent structures, assemblies, and devices.

What I claim is:

1. A game device comprising:

an elongated trunk element;

a plurality of elongated limb elements;

trunk means defining an elongated trunk cavity for axially positioning said elongated trunk element for reciprocal movement therein, said trunk means including a plurality of limb means each defining a limb cavity for axially positioning at least one of said limb elements therein;

means for hingedly connecting said plurality of limb elements to said trunk element;

platform means transversely mounted to said trunk element for supporting weighted objects thereon; and biasing means for biasing said trunk element in an upward direction so that said trunk element will be yieldably depressed in said trunk cavity in response to successive weighted objects coming to rest upon said platform means.

2. A game device as in claim 1 further comprising a base member, and means for attaching said elongated trunk member generally perpendicularly to said base member.

3. A game device as in claim 1 wherein each of said limb elements extends a predetermined distance beyond the outwardly extended terminal end of said limb means.

4. A game device as in claim 3 further comprising at least one prize object, and attaching means for releasably and appendantly attaching said prize object to at least one predetermined said limb element.

5. A game device as in claim 4 wherein each of said limb elements has at least one said prize object and said attaching means releasably and appendantly attached thereto.

6. A game device as in claim 1 wherein said limb means radially extends from said trunk means and are angularly disposed in an upwardly direction towards said platform means.

7. A game device as in claim 6 wherein said platform means is a generally circular member defining a generally planar surface.

8. A game device comprising:

an elongated first member defining an elongated first cavity;

a plurality of elongated second members fixedly attached at one end to said first member and radially extending therefrom, each of said second members defining an elongated second cavity which at said one end is in juxtaposition with said first cavity;

an elongated first shaft element axially positioned in said first cavity for reciprocal movement therein;

a plurality of elongated second shaft elements each being associated with a predetermined second member and being axially positioned in said associated second cavity;

means for hingedly connecting said plurality of elongated second shaft elements to said first shaft element;

means defining at least one surface generally transversely mounted to said first shaft element for supporting weighted objects thereon; and spring means associated with said first shaft element for exerting a predetermined axial force in opposition to an incremental increase in force caused by successive weighted objects being supported upon said surface defining means, said predetermined axial force being of sufficient magnitude so that successive weighted objects supported upon said surface defining means will successively and incrementally overcome said predetermined axial force exerted by said spring means thereby responsively causing said first shaft element to be yieldably depressed in said first cavity a predetermined distance until said predetermined axial force of said spring means achieves a magnitude of equilibrium with said incremental increase in force caused by said weighted objects.

9. A game device as in claim 8 further comprising a base member, and means for attaching said elongated first member generally perpendicularly to said base member.

10. A game device as in claim 8 wherein each of said elongated second shaft elements extends a predetermined distance beyond the end opposite said one end of said second member associated therewith.

11. A game device as in claim 10 further comprising at least one prize object, and attaching means for releasably and appendantly attaching said prize object to a predetermined said second element.

12. A game device as in claim 11 wherein each of said second shaft elements has at least one said prize object and said attaching means releasably and appendantly attached thereto.

13. A game device as in claim 8 wherein said second members are angularly disposed in an upward direction towards said surface defining means.

14. A game device as in claim 8 wherein said surface defining means is a generally planar member defining at least one generally planar surface.

15. A game device as in claim 14 wherein said generally planar member is circularly shaped.

* * * * *